United States Patent [19]

Schaenzer

[11] 4,325,282

[45] Apr. 20, 1982

[54] UNITIZED CASE RESIZER AND TRIMMER

[76] Inventor: Mark Schaenzer, 11737 N. Solar Ave. 77W, Mequon, Wis. 53092

[21] Appl. No.: 168,012

[22] Filed: Jul. 14, 1980

[51] Int. Cl.[3] ..... F42B 33/00

[52] U.S. Cl. ..... 86/24; 29/1.32

[58] Field of Search ..... 29/1.32; 86/10, 24, 86/33, 37, 40, 43

[56] References Cited

U.S. PATENT DOCUMENTS

| | | | |
|---|---|---|---|
| 2,359,954 | 10/1944 | Whipple | 29/1.32 |
| 3,134,293 | 5/1964 | Lee | 86/24 |
| 3,137,914 | 6/1964 | Manshel | 29/1.32 |
| 3,174,390 | 3/1965 | Jacobsen | 86/24 |
| 3,199,168 | 10/1965 | Rhine | 29/1.32 |
| 3,251,114 | 5/1966 | Lewis | 29/1.32 |
| 3,555,641 | 1/1971 | Lee | 29/1.32 |
| 4,189,980 | 2/1980 | Schaenzer | 86/24 |

*Primary Examiner*—Leland A. Sebastian

[57] ABSTRACT

A hand-operated reloading apparatus for resizing and trimming used rifle and pistol centerfire cartridges includes a hollow body having a cartridge-receiving portion for receiving and reshaping a used cartridge forced therein, and a coaxial cutter-receiving portion for receiving a rotatable cutter that trims the length of the used cartridge to its proper standard dimension while the cartridge is positioned within the cartridge-receiving portion of the body. The apparatus also includes a rotatable cutter and may also include a knock-out rod for forcing the used cartridge out of the cartridge-receiving portion of the body after it has been resized and trimmed.

6 Claims, 4 Drawing Figures

UNITIZED CASE RESIZER AND TRIMMER

BACKGROUND OF THE INVENTION

This invention relates to reloading tools, and more particularly to a hand-operated apparatus for resizing and trimming used centerfire cartridges.

When a firearm discharges a bullet, the cartridge casing may stretch or otherwise become deformed under the explosive force. If a person desires to reuse and reload the empty casing to reduce the cost of cartridges, the casing must be reshaped and trimmed to its original standard dimensions in order that proper chambering in a rifle or pistol may be insured. The economic advantages of reloading cartridges are further enhanced if the tools required for reloading are themselves inexpensive and easy to use.

The prior art has provided various types of relatively inexpensive hand-operated tools for resizing as well as trimming used cartridges. Examples of resizing tools are shown in U.S. Pat. No. 3,134,293 issued May 26, 1964 to R. J. Lee, U.S. Pat. No. 4,189,980 issued Feb. 26, 1980 to G. N. Schaenzer. These types of resizing tools include a sizing die into which a cartridge casing is driven by mechanical force.

Various types of cartridge trimming tools have also been provided. One example of a trimming tool is shown in U.S. Pat. No. 3,174,390 issued Mar. 23, 1965 to C. R. Jacobsen which includes an adjustment plub screwed into a housing and a spring to bias a cutter into engagement with the cartridge to be trimmed. However, tools of this type may result in improper case lengths if the adjustment plug is not accurately positioned, or non-uniform case lengths if the adjustment plub shifts from its original proper position.

Another trimming tool is shown in U.S. Pat. No. 3,555,641 issued Jan. 19, 1971 to R. J. Lee that includes a guide member threadedly engaged in the tip of a cutter. The guide member is inserted inside the cartridge case and limits the amount of cutting action by the cutter. However, tools of this type include a number of parts resulting in increased manufacturing costs.

The present invention provides an easy to use hand-operated reloading tool for both resizing and trimming used cartridges which is simple and inexpensive to manufacture.

SUMMARY OF THE INVENTION

The present invention provides an improved hand-operated reloading apparatus for resizing and trimming used rifle and pistol centerfire cartridges, and more specifically includes a hollow body having a bore with a cartridge-receiving portion for receiving and reshaping a used cartridge forced therein, and a coaxial cutter-receiving portion for receiving a rotatable cutter that trims the length of a used cartridge to its proper standard dimension while the cartridge is positioned within the cartridge-receiving portion of the body. The apparatus also includes a rotatable cutter and may include a knock-out means for forcing the used cartridge out of the cartridge-receiving portion of the body after it has been resized and trimmed.

The present invention provides an apparatus for performing the separate steps of resizing a cartridge and trimming the cartridge to its standard length in a single unit. The apparatus includes fewer components than other tools commonly used to perform the same reloading steps, and as a result the apparatus is both less expensive and easier to use. The apparatus of the invention may be used to accurately reshape and trim a used cartridge to its original standard dimensions. A uniform length for all cartridges is thus assured.

Accordingly, in its preferred form, the invention provides a hand-operated apparatus for resizing and trimming a used cartridge that includes a body having a longitudinal bore formed therethrough with a cutter-receiving portion at one end, and a coaxial cartridge-receiving portion at its other end for receiving and reshaping the external configuration of a used cartridge driven therein by mechanical force, and a rotatable cutter having a cutting edge adapted to be inserted into the cutter-receiving portion of the bore to engage and trim the neck of a used cartridge disposed within the cartridge-receiving portion of the bore. The cutter has a projecting shoulder formed along its length engageable with the sizing body so that the cutting edge may be inserted within the cutter-receiving portion of the bore only a predetermined distance to trim the overall length of the used cartridge to its proper standard dimension. The cutter-receiving portion of the bore of the sizing body also functions to catch any shavings trimmed from the cartridge so that they do not fall into the interior of the cartridge and can be disposed of properly. A knock-out rod having an end receivable within the cartridge is also provided for forcing the used cartridge out of the cartridge-receiving portion of the bore after the cartridge has been reshaped and trimmed.

The cutter and knock-out rod may be used with a plurality of interchangeable sizing bodies, each of which must be manufactured separately depending upon the caliber of the cartridge being reshaped and trimmed. The sizing bodies are easily interchanged without the aid of any additional tools, and no adjustment of parts is necessary when changing calibers.

It is a general object of the invention to provide a reloading apparatus for accurately reshaping and trimming a used cartridge to its original standard dimensions.

It is another object of the invention to provide a reloading apparatus consisting of fewer components that are easier to use than other commonly used reshaping and trimming tools.

The foregoing and other objects and advantages of the invention will appear from the following description. In the description, reference is made to the accompanying drawings which form a part hereof, and in which there is shown by way of illustration and not of limitation, a preferred embodiment of the invention. Such embodiment does not represent the full scope of the invention, and reference is made to the claims herein for interpreting the breadth of the invention.

DESCRIPTION OF THE PREFERRED EMBODIMENT

Figure 1:
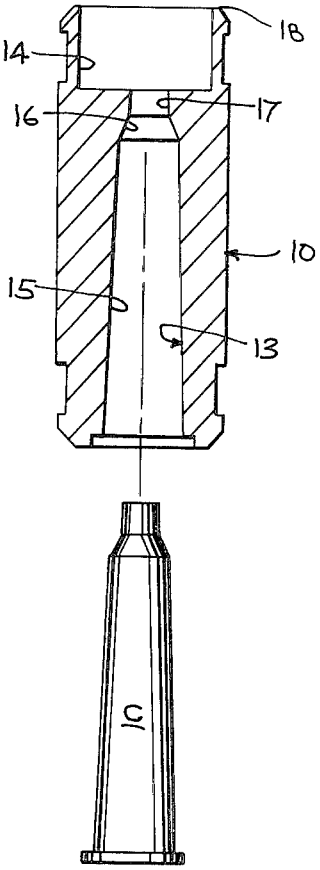
FIG. 1 is a cross section view in elevation of the sizing body of the reloading apparatus of the invention with a used cartridge shown in position for insertion into the cartridge-receiving resizing portion of the sizing body.

Referring to the drawings, FIGS. 1–4 show a hand-operated reloading apparatus for resizing and trimming used rifle and pistol cartridges, commonly called centerfire cartridges. The preferred reloading apparatus is comprised of a hollow sizing die or body 10, a cutter 11, and an elongated knock-out rod 12 for forcing a cartridge C out of the body 10 after it has been resized and trimmed.

Figure 2:
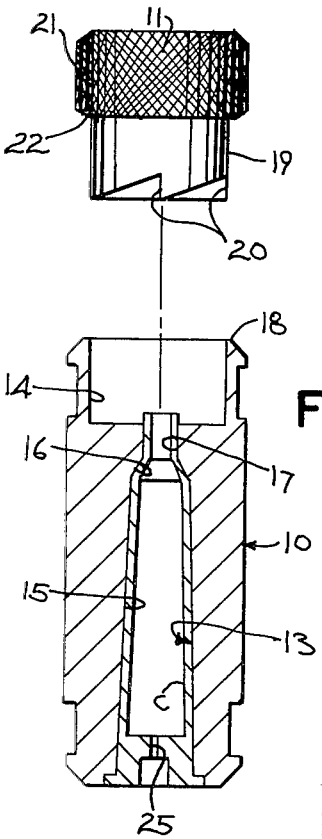
FIG. 2 is a cross section view in elevation of the sizing body of FIG. 1 with a resized cartridge shown therein, and of the cutter of the reloading apparatus of the invention for trimming the cartridge neck.

Referring to FIG. 1 of the drawings, the hollow sizing die or body 10 includes a longitudinal bore 13 formed therethrough having a cutter-receiving portion 14 at its upper end and a coaxial cartridge-receiving portion 15 at its lower end. The cartridge-receiving portion 15 of the bore 13 is formed in the shape of centerfire cartridge C, and is adpated to receive cartridge C as shown in FIG. 2. The lower end of cartridge-receiving portion 15 conforms to the shape of the body of cartridge C and may be appropriately called the cartridge body-receiving portion, and the upper end of the cartridge-receiving portion 15 tapers upwardly and inwardly to form a shoulder 16. Above the shoulder 16 is a cylindrical neck-receiving portion 17 which together with the shoulder 16 is functional to resize the neck of cartridge C when cartridge C is forced into the sizing body 10 during the resizing operation. The cartridge-receiving portion 15 of the bore 13 and the longitudinal distance from the top of the neck-receiving portion 17 to the bottom of the cartridge-receiving portion 15 is dimensioned to correspond to the proper overall length of the desired cartridge caliber being reshaped and resized.

The longitudinal bore 13 also includes a cylindrical cutter-receiving portion 14 above the neck-receiving portion 17 having a diameter larger than that of the neck-receiving portion 17. The cutter-receiving portion 14 extends upwardly from the neck-receiving portion 17 so that an annular rim 18 is formed at the upper end of the sizing body 10. The cutter-receiving portion 14 is intended to receive the cutter 11 during the cartridge trimming operation shown in FIG. 3, and has a depth and width of sufficient dimensions to accommodate the cutter 11. In particular, the depth of the cutter-receiving portion 14 cooperates with the cutter 11 to provide a means for accurately trimming the cartridge C to its proper overall length, as will hereinafter be described.

The cutter 11 of the reloading apparatus includes a cylindrical cutting head 19 having a plurality of cutting edges 20 (only two of which are shown) formed in its lower end, and a cylindrical finger-grip portion 21 at its upper end, as seen in FIG. 2. Preferably, the cutting head 19 includes four cutting edges 20 with one edge 20 provided in each quadrant of the cutting head 19. The cutter 11 is machined from steel, and if desired the external surface of the finger-grip portion 21 may be knurled in a diamond pattern as shown to provide a non-slippery grip for the user's fingers. The diameter of the finger-grip portion 21 is greater than the diameter of the cutting head 19 resulting in the formation of a circumferentially projecting shoulder 22 on the cutter 11. The shoulder 22 is formed along the length of the cutter 11 at a spaced distance from the cutting edges 20 so that the longitudinal length of the cutting head 19 is identical to the depth of the cutter-receiving portion 14 of bore 13.

The preferred resizing and trimming apparatus of the invention further includes an elongated knock-out rod 12 which is adapted to be inserted into the cutter-receiving portion 14 of bore 13 and through the open neck of cartridge C after cartridge C has been resized and trimmed. The elongated rod 12 includes a lower end 23 adapted to engage the inside of the base of the cartridge (FIG. 4), and an upper end 24 adpated to extend from the upper end of the sizing body 10 as shown. It should be noted that the diameter of the rod 12 is preferably greater than the diameter of the primer bore 25 of cartridge C so as not to damage the bore 25, and less than the diameter of the neck of cartridge C so as to permit easy entry into the interior of cartridge C.

The first step of the cartridge resizing and trimming process using the apparatus of the present invention comprises placing the sizing body 10 over a vertically positioned cartridge C and tapping the upper end of the sizing body 10 with a rubber mallet or the like, until the sizing body 10 is forced down over cartridge C in the manner shown in FIGS. 1 and 2. Cartridge C is forced into the cartridge-receiving portion 15 of bore 13 until its base is flush with the lower end of body 10. This operation resizes and reshapes the outside configuration of cartridge C, and in particular reshapes the neck of cartridge C to its proper dimensions. The friction between cartridge C and sizing body 10 holds cartridge C in the cartridge-receiving portion 15 of bore 13 for the next operation.

Figure 3:
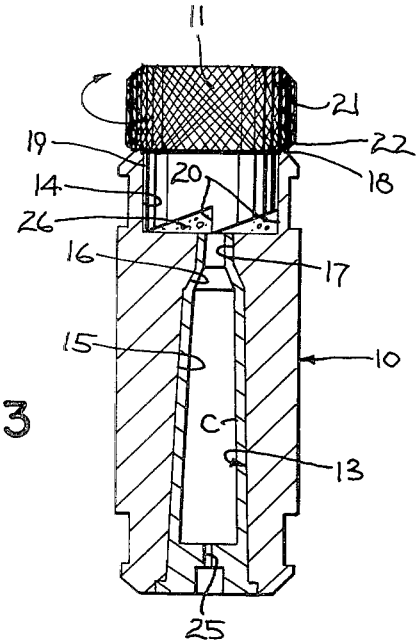
FIG. 3 is a cross section view in elevation of the sizing body and cutter shown in FIGS. 1 and 2 showing the cartridge neck being trimmed.

After cartridge C has been resized by being forced into sizing body 10, the next step is to trim off any excess metal from the neck of cartridge C. When a bullet is discharged, its cartridge case may stretch due to the force of the explosion, and as a result, if one desires to reuse and reload the cartridge its overall length must be reduced so that proper chambering may be insured in the rifle or pistol. As seen in FIG. 2, a cartridge that has been stretched excessively will result in its neck extending beyond the neck-receiving portion 17 and into the cutter-receiving portion 14 of bore 13 when the cartridge is positioned within the sizing body 10. The head 19 of cutter 11 may then be inserted into the cutter-receiving portion 14 of bore 13 until the cutting edges 20 bear against the top peripheral edge of the open neck of cartridge C. The cutter 11 is then forced toward cartridge C and simultaneously rotated as shown in FIG. 3 so that the cutting edges 20 of cutter 11 cut and trim off the excess portion of the neck of cartridge C. The cutter 11 is rotated until its shoulder 22 engages the rim 18 at the upper end of sizing body 10. When the shoulder 22 rests against the top of body 10, cartridge C is trimmed to its proper overall length.

The trimmed shavings resulting from this operation will travel upwardly and outwardly along the cutting edges 20 toward the periphery of the cutter-receiving portion 14 of bore 13, as shown at 26 in FIG. 3, so that they do not fall into the interior of cartridge C. The cutter 11 may then be removed from the cutter-receiving portion 13 of bore 14, and the shavings may be properly disposed by turning the sizing body 10 upside down and lightly tapping its side.

Figure 4:
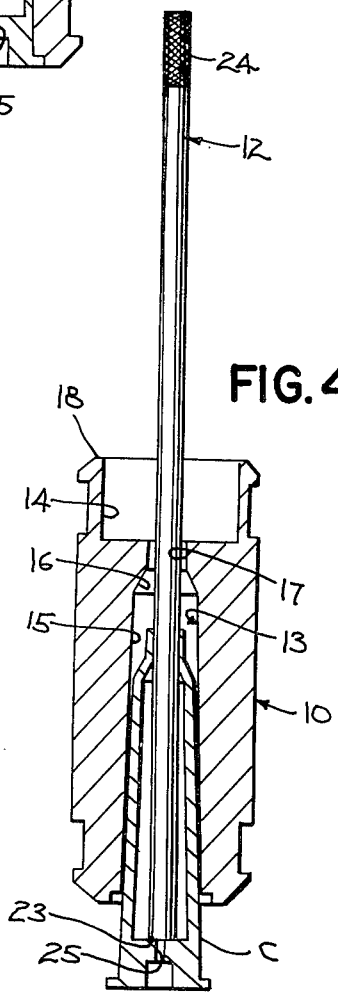
FIG. 4 is a cross section view in elevation of the sizing body of FIG. 1 showing a knock-out rod for removing a cartridge from the sizing body positioned within a cartridge, and showing a cartridge removed from the sizing body.

Removal of cartridge C from sizing body 10 is accomplished by the elongated knock-out rod 12. Rod 12 is inserted into the cutter-receiving portion 14 of bore 13 and through the open neck of cartridge C until its lower end 23 rests against the inside of the base of cartridge C, as shown in FIG. 4. The upper end 24 of rod 12 is then tapped with a rubber mallet or the like until cartridge C is free from the cartridge-receiving portion 15 of bore 13. Cartridge C may then be easily removed from the sizing body 10, and the rod 12 may be removed from the interior of cartridge C. Cartridge C is thus resized and trimmed to its original standard dimensions. The above-described operations may then be repeated with other cartridges unitl the desired number of cartridges have been resized and trimmed.

A preferred apparatus has been shown and described for resizing and trimming a used centerfire cartridge C. It is apparent, however, that various modifications may be made from the specific structure described. As previously noted, it is contemplated that the apparatus of the invention be used to resize and trim a variety of cartridge calibers. To this end, the interior dimensions of sizing body 10 will need to be altered slightly in order to accommodate different calibers. In particular, the taper and diameters of the various portions of the cartridge-receiving portion 15 of bore 13 will need to be altered slightly as well as the length from the top of the neck-receiving portion 17 to the bottom of the cartridge-receiving portion 15. Thus, the cutter 11 and knock-out rod 12 may be used with a plurality of interchangeable sizing bodies 10 depending upon the caliber of the cartridge to be resized and reshaped. It should also be noted that a knock-out rod such as that specifically shown and described need not necessarily be used. Rather, any type of knock-out means that functions to force the reshaped and trimmed cartridge out of the body of the apparatus may be used. In view of these possible modifications and others, the invention is not intended to be limited by the showing or description herein or in any other manner, except insofar as may specifically be required by the claims.

I claim:

1. An apparatus for resizing and trimming a used cartridge, comprising:

a sizing body having a longitudinal bore formed therethrough that includes a cutter-receiving portion at one end, and a coaxial cartridge-receiving portion at its other end for receiving and reshaping at least a portion of the external configuration of a used cartridge driven therein by mechanical force; and a rotatable cutter having a cutting edge adapted to be inserted into the cutter-receiving portion of said bore to engage and trim the neck of a used cartridge disposed within the cartridge-receiving portion of said bore, said cutter having a projecting shoulder formed along its length engageable with said body so that said cutting edge may be inserted within the cutter-receiving portion of said bore only a predetermined distance to trim the overall length of the used cartridge to its proper standard dimension.

2. The apparatus of claim 1, further including:

knock-out means for forcing the used cartridge out of the cartridge-receiving portion of said bore by mechanical force.

3. The apparatus of claim 2, wherein:

said knock-out means comprises a rod having an end receivable within said cartridge.

4. The apparatus of claim 1, wherein:

the cutter-receiving portion of the bore of said body has a diameter larger than the diameter of the cartridge-receiving portion of said bore and said cutter-receiving portion cooperates with the cutting edge of said cutter to catch the shavings trimmed from said cartridge.

5. An apparatus for resizing and trimming a used cartridge, comprising:

a sizing body having a longitudinal bore formed therethrough that includes a cutter-receiving portion at one end, and a coaxial cartridge-receiving portion at its other end for receiving a used cartridge therein, said cartridge-receiving portion having a cartridge neck-receiving portion and a cartridge body-receiving portion for reshaping the external configuration of a used cartridge driven therein by mechanical force; and a rotatable cutter having a cutting head with a plurality of cutting edges formed therein, said cutting edges adapted to be inserted into the cutter-receiving portion of said bore to engage and trim the neck of a used cartridge disposed within the cartridge-receiving portion of said bore, said cutter having a circumferentially projecting shoulder formed along its length at a spaced distance from said cutting edges engageable with said one end of said body so that said cutting edges may be inserted within the cutter-receiving portion of said bore only a predetermined distance to trim the overall length of the used cartridge to its proper standard dimension.

6. The apparatus of claim 5, further including:

a knock-out rod having an end receivable within said cartridge for forcing the used cartridge out of the cartridge-receiving portion of said bore by mechanical force.

* * * * *